US010858863B2

(12) United States Patent
Johnston et al.

(10) Patent No.: US 10,858,863 B2
(45) Date of Patent: Dec. 8, 2020

(54) SELF-LOCKING LOCK FOR MERCHANDISE SECURITY

(71) Applicant: InVue Security Products Inc., Charlotte, NC (US)

(72) Inventors: Michael R. Johnston, Waxhaw, NC (US); Jeffrey A. Grant, Charlotte, NC (US); Gary A. Taylor, Fort Mill, SC (US); David N. Berglund, Indian Trail, NC (US); Karen Bellum Bomber, Lake Wylie, SC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

(21) Appl. No.: 15/567,880

(22) PCT Filed: Apr. 20, 2016

(86) PCT No.: PCT/US2016/028376

§ 371 (c)(1),
(2) Date: Oct. 19, 2017

(87) PCT Pub. No.: WO2016/172164

PCT Pub. Date: Oct. 27, 2016

(65) Prior Publication Data

US 2018/0094455 A1 Apr. 5, 2018

Related U.S. Application Data

(60) Provisional application No. 62/184,631, filed on Jun. 25, 2015, provisional application No. 62/152,397, filed on Apr. 24, 2015.

(51) Int. Cl.
*E05B 47/00* (2006.01)
*E05B 47/02* (2006.01)
(Continued)

(52) U.S. Cl.
CPC ..... *E05B 47/0012* (2013.01); *E05B 15/0205* (2013.01); *E05B 47/026* (2013.01);
(Continued)

(58) Field of Classification Search
CPC ..... E05B 47/0012; E05B 47/026; E05B 15/0205; E05B 65/46; E05B 2047/0058;
(Continued)

(56) References Cited

U.S. PATENT DOCUMENTS 293,424 A * 2/1884 Copeland et al.
629,446 A * 7/1899 James
(Continued)

FOREIGN PATENT DOCUMENTS

DE 1405693 A1 8/1995
EP 2037063 B1 5/2013

OTHER PUBLICATIONS

"5L Series Latchbolt"; <http://www.bestaccess.com/products/>; retrieved Dec. 8, 2014; 3 pages.
(Continued)

*Primary Examiner* — Lloyd A Gall
(74) *Attorney, Agent, or Firm* — InVue Security Products Inc.

(57) ABSTRACT

Embodiments are directed to merchandise security devices, systems, and methods for protecting an item of merchandise from theft. For example, a merchandise security device may include a lock configured to be secured to a merchandise fixture and a strike plate configured to be secured to the merchandise fixture. The lock includes an actuator configured to extend into operable engagement with the strike plate in a locked state and to retract out of operable engagement with the strike plate in an unlocked state. In addition, the actuator includes a curved portion at its free end and a straight portion extending from the curved portion, and the
(Continued)

strike plate is configured to receive the entire curved portion in the locked state.

20 Claims, 9 Drawing Sheets

(51) Int. Cl.
*E05B 15/02* (2006.01)
*E05B 65/46* (2017.01)

(52) U.S. Cl.
CPC ..... *E05B 65/46* (2013.01); *E05B 2047/0058* (2013.01); *E05B 2047/0063* (2013.01); *E05B 2047/0069* (2013.01); *E05B 2047/0094* (2013.01)

(58) Field of Classification Search
CPC ..... E05B 2047/0094; E05B 2047/0063; E05B 2047/0069
USPC ... 70/143, 462, 186, 278.7, 279.1, 280–282, 70/77–88; 292/244, 144, DIG. 44
See application file for complete search history.

(56) References Cited

U.S. PATENT DOCUMENTS 1,068,235 A * 7/1913 Gaunt ..... E05B 55/00 292/DIG. 61
1,378,504 A * 5/1921 White ..... E05B 63/22 292/193
1,701,790 A * 2/1929 Morin, Jr. ..... E05B 55/00 70/107
2,055,913 A * 9/1936 Schwarz ..... E05B 63/242 292/149
2,625,812 A * 1/1953 Hay ..... E05B 63/22 292/153
2,667,057 A * 1/1954 Thorne ..... E05B 63/202 292/169.14
2,793,520 A * 5/1957 Navarrete Can Dia Angel ..... E05B 63/0017 70/143
3,353,858 A * 11/1967 Neary ..... E05B 55/005 292/164
3,907,347 A * 9/1975 Hollis ..... E05C 1/08 292/169.13
4,021,065 A * 5/1977 Geringer ..... E05B 47/0002 292/144
4,255,953 A * 3/1981 Dietrich ..... E05B 55/005 70/107
4,333,324 A * 6/1982 Dietrich ..... E05B 55/005 292/172
4,372,594 A * 2/1983 Gater ..... E05B 63/06 292/1.5
4,594,864 A * 6/1986 Hart ..... E05B 55/005 292/1.5
4,679,416 A * 7/1987 Kambic ..... E05B 47/0012 292/169.13
4,691,543 A * 9/1987 Watts ..... E05B 55/00 292/150
4,799,719 A * 1/1989 Wood ..... E05B 47/0012 292/144
4,848,118 A * 7/1989 Tesone ..... E05B 15/10 70/419
4,866,963 A 9/1989 Leininger et al.
4,887,442 A * 12/1989 Lavelle ..... E05B 47/0673 70/143
4,945,737 A * 8/1990 Hart ..... E05B 55/005 292/167
4,977,765 A 12/1990 Legault et al.
5,044,182 A * 9/1991 Totten ..... E05B 55/12 292/169.13
5,201,200 A * 4/1993 Hauber ..... E05B 59/00 70/107
5,319,362 A 6/1994 Hyatt, Jr.
5,329,865 A 7/1994 McWard
5,359,322 A 10/1994 Murray
5,437,174 A 8/1995 Aydin
5,657,652 A 8/1997 Martin
5,666,830 A * 9/1997 Litvin ..... E05B 9/00 292/165
5,712,626 A 1/1998 Andreou et al.
5,933,086 A 8/1999 Tischendorf et al.
5,942,985 A 8/1999 Chin
6,107,934 A 8/2000 Andreou et al.
6,135,512 A * 10/2000 Galvin ..... E05B 13/004 292/163
6,297,725 B1 10/2001 Tischendort et al.
6,374,653 B1 4/2002 Gokcebay et al.
6,449,995 B1 9/2002 Paolini et al.
6,666,054 B1 12/2003 Hsich
6,668,606 B1 * 12/2003 Russell ..... E05B 47/063 70/278.3
6,720,861 B1 4/2004 Rodenbeck et al.
6,779,310 B2 8/2004 Grover
6,950,033 B1 * 9/2005 Guyre ..... E05B 17/10 340/542
6,965,294 B1 11/2005 Elliott et al.
7,151,324 B2 * 12/2006 Neuhoff ..... B60R 25/02153 307/10.2
7,263,865 B2 9/2007 Miller et al.
7,336,150 B2 * 2/2008 Gokcebay ..... E05B 47/06 340/5.2
7,695,032 B2 * 4/2010 Bodily ..... E05B 63/06 292/1.5
7,874,189 B2 1/2011 Martin
7,874,190 B2 * 1/2011 Krisch ..... E05B 47/0649 70/277
8,419,083 B2 4/2013 Burmesch
8,601,839 B1 12/2013 Liu
8,820,622 B2 9/2014 Chen et al.
8,922,333 B1 12/2014 Kirkjan
8,978,428 B2 3/2015 Trent et al.
2004/0055345 A1 * 3/2004 Moore ..... B60R 25/23 70/257
2007/0257773 A1 * 11/2007 Hill ..... E05B 17/2088 340/5.73
2008/0307837 A1 * 12/2008 Greiner ..... E05B 47/0012 70/282
2009/0273440 A1 11/2009 Marschalek et al.
2011/0084506 A1 * 4/2011 Roatis ..... E05B 17/0029 292/240
2012/0047972 A1 3/2012 Grant et al.
2014/0318199 A1 10/2014 Gokcebay
2014/0366594 A1 12/2014 Grant et al.
2015/0101370 A1 4/2015 Russo et al.
2015/0102904 A1 4/2015 Oh et al.
2015/0107316 A1 4/2015 Kirkjan

OTHER PUBLICATIONS

"Deltalock Showcase, Cabinet and Casework Locking Systems"; <http://www.deltalock.biz>; 2 pages.
"Medeco XT Padlock Cylinders"; <http://www.medeco.com/en/site/medeco/products/>; 1 page.
"Optigaurd—Optilock"; <http://www.optiguard.eu>; retrieved Apr. 6, 2015; 1 page.
International Search Report and Written Opinion from corresponding International Application No. PCT/US2016/028376, dated Jul. 21, 2016 (12 pages).

* cited by examiner

SELF-LOCKING LOCK FOR MERCHANDISE SECURITY

CROSS REFERENCE TO RELATED APPLICATIONS

The present application is a 371 national phase entry of International Application No. PCT/US2016/028376, filed Apr. 20, 2016, which claims the benefit of and priority to U.S. Provisional Application No. 62/152,397, filed Apr. 24, 2015, and U.S. Provisional Application No. 62/184,631, filed Jun. 25, 2015, the contents of which are each incorporated by reference herein in their entirety.

FIELD OF THE INVENTION

Embodiments of the invention relate generally to security devices, systems, and methods for protecting an item of merchandise from theft. More particularly, embodiments of the invention relate to security devices, systems and methods including self-locking functionality for merchandise security.

BACKGROUND OF THE INVENTION

It is common practice for retailers to store and/or display relatively expensive items of merchandise on or within a merchandise security device, such as a security display (e.g. alarming stand), security fixture (e.g. locking hook, shelf, cabinet, etc.) or security packaging (e.g. merchandise keeper). Regardless, the security device stores and/or displays an item of merchandise so that a potential purchaser may view, and in some instances, interact with the item before making a decision whether to purchase the item. At the same time, the item is secured on or within the merchandise security device so as to prevent, or at least deter, theft of the item. The value of the item, however, may make it an attractive target for a shoplifter despite the presence of a merchandise security device. A determined shoplifter may attempt to detach the item from the security display or to remove the item from the security fixture or from within the security packaging. Alternatively, the shoplifter may attempt to remove all or a portion of the security device from the display area along with the item of merchandise.

In the case of a security fixture, and in particular a merchandise display cabinet or drawer, the merchandise security device is oftentimes locked with a lock to prevent merchandise from being removed from the cabinet or drawer without the assistance of an authorized person, such as a sales associate.

BRIEF SUMMARY

Embodiments of the present invention are directed to merchandise security devices and methods for protecting items of merchandise from theft. In one embodiment, a merchandise security device including a lock configured to be secured to a merchandise fixture and a strike plate configured to be secured to the merchandise fixture. The lock includes an actuator configured to extend into operable engagement with the strike plate in a locked state and to retract out of operable engagement with the strike plate in an unlocked state. A portion of the actuator extending between a bottom surface of the strike plate and a top surface of the merchandise fixture in the locked state may have a uniform cross section or is not angled or curved. In one aspect, the actuator includes a curved portion at its free end and a straight portion extending from the curved portion, and the strike plate is configured to receive the entire curved portion in the locked state.

In one embodiment, a method includes securing a strike plate to a merchandise fixture and attaching a lock to the merchandise fixture. The lock includes an actuator configured to extend into operable engagement with the strike plate in a locked state and to retract out of operable engagement with the strike plate in an unlocked state. The actuator includes a curved portion at its free end and a straight portion extending from the curved portion, and the strike plate is configured to receive the entire curved portion in the locked state. The method further includes actuating the lock to move the actuator from the locked state to the unlocked state.

In another embodiment, a method includes selectively attaching a lock in the same orientation to one of a fixed merchandise fixture or a movable merchandise fixture. The lock is configured to move between locked and unlocked states. The method also includes selectively securing a strike plate to one of the fixed merchandise fixture or the movable merchandise fixture, opposite that of the lock.

In another embodiment, a merchandise security device includes a lock configured to be selectively secured to a merchandise fixture in a first orientation or a second orientation opposite the first orientation. The merchandise security device also includes a strike plate configured to be secured to the merchandise fixture. The lock includes an actuator configured to extend into operable engagement with the strike plate in a locked state and to retract out of operable engagement with the strike plate in an unlocked state.

In one embodiment, a merchandise security device includes an electronic lock configured to move between locked and unlocked states and to be secured to a merchandise fixture. The electronic lock is configured to move automatically from the unlocked state to the locked state after a predetermined period of time.

In another embodiment, a merchandise security system includes an electronic lock configured to move between locked and unlocked states and to be secured to a merchandise fixture and an electronic device configured to communicate with the electronic device to unlock the electronic lock. The electronic lock is configured to move automatically from the unlocked state to the locked state after a predetermined period of time.

In another embodiment, a method includes attaching an electronic lock to a merchandise fixture. The electronic lock is configured to move between locked and unlocked states and to be secured to a merchandise fixture. The method also includes actuating an electronic key to unlock the electronic lock. The electronic lock is configured to move automatically from the unlocked state to the locked state after a predetermined period of time.

DETAILED DESCRIPTION OF EMBODIMENTS OF THE INVENTION

Figure 1:
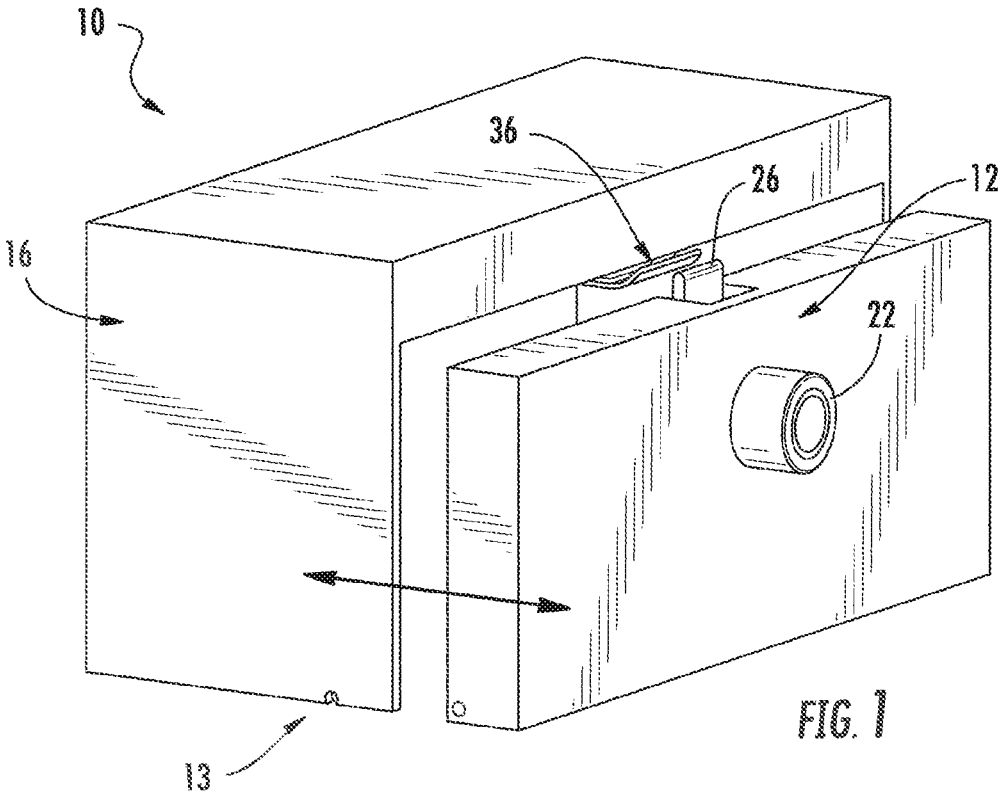
FIG. 1 is a perspective view of a merchandise security device, with a merchandise drawer in an open position, according to one embodiment of the present invention.
Figure 2:
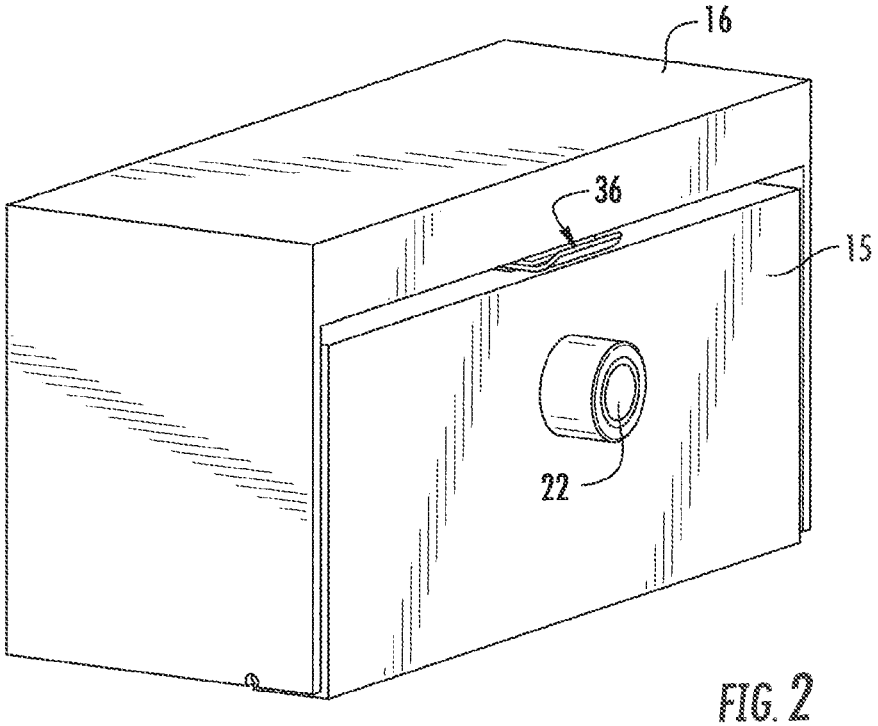
FIG. 2 is another perspective view of the merchandise security device shown in FIG. 1, with the merchandise drawer in a closed position.

Referring now to the accompanying drawing figures wherein like reference numerals denote like elements throughout the various views, one or more embodiments of a merchandise security device and system are shown. A merchandise security device and system according to embodiments of the invention is operable for use with a merchandise fixture that stores and/or displays merchandise, for example, in a retail store. In the embodiments shown and described herein, a merchandise security device 10 includes an electronic lock 12 and an electronic device 50 configured for at least unlocking a merchandise fixture 13.

Figure 16:
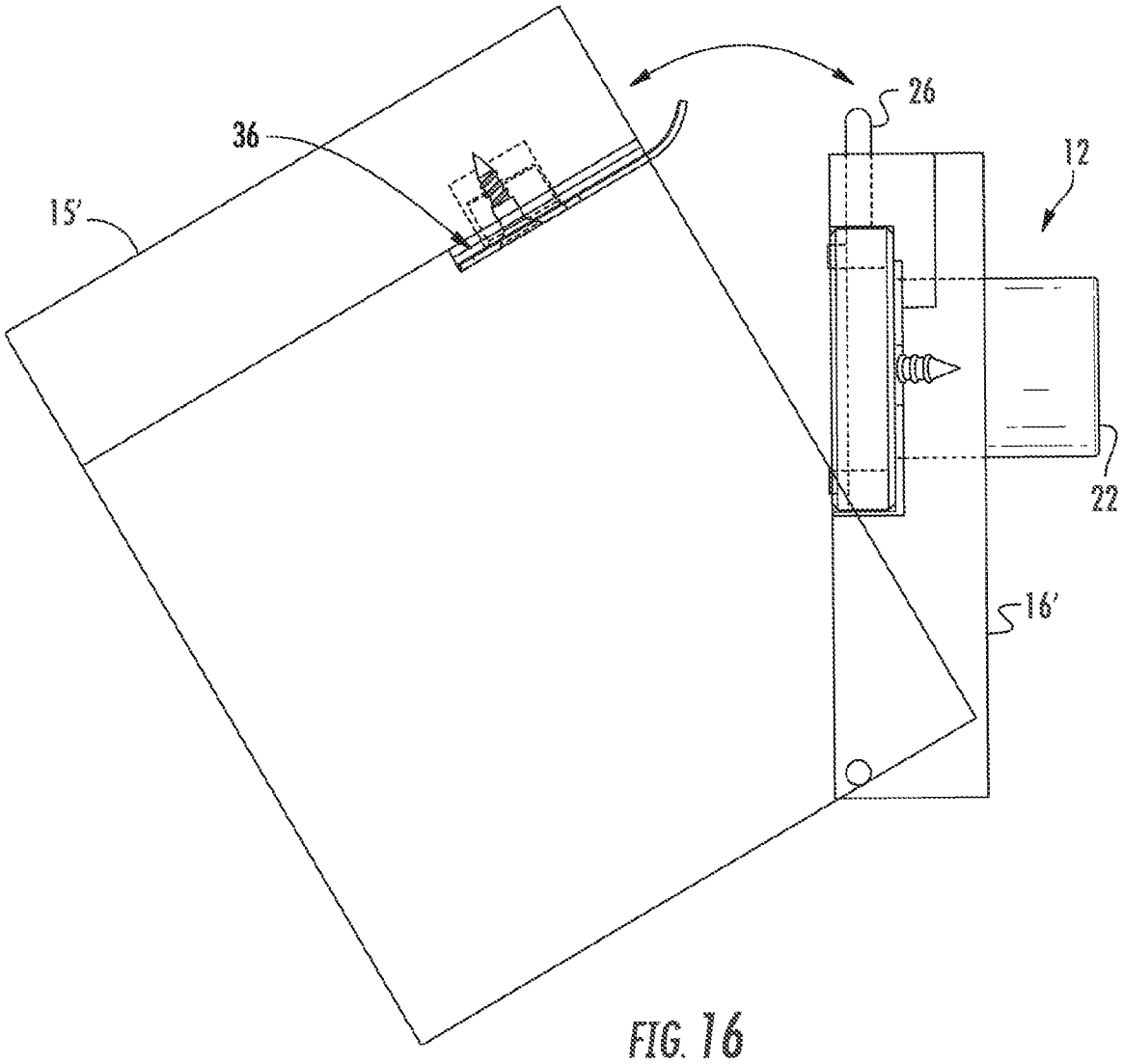
FIG. 16 is a side view of a merchandise security device according to another embodiment of the present invention.

An embodiment of a merchandise security device 10 according to the invention is illustrated in FIGS. 1-5. The merchandise security device 10 depicted therein is operable for use with a merchandise fixture 13, for example, a merchandise drawer 15 adapted for storing and protecting items of merchandise disposed within the drawer. The merchandise fixture may further include a table, cabinet, desk, or other support structure 16 in operable engagement with the drawer 15 that allows the drawer to be moved into and out of engagement with the support structure. The drawer 15 may include a handle for allowing a user to pull the drawer away from the support structure 16 to access to an item of merchandise, and to push the drawer 15 towards the support structure 16 for preventing access to an item of merchandise when the drawer 15 is in a closed and locked configuration. In other cases, a portion of the electronic lock 12 may protrude outwardly from the drawer 15 and be configured to be used as a handle. Although the illustrated embodiments are discussed for use with a drawer, it should be noted that the invention is applicable to any number of merchandise fixtures, such as merchandise display cabinets, doors, or the like that utilize a locking mechanism. For example, FIG. 16 shows an embodiment where the merchandise security fixture 13 includes a pivoting door 15'.

In some embodiments, the electronic lock 12 and the electronic device 50 are similar to those disclosed in U.S. Provisional Application No. 62/152,397, entitled Self-Locking Lock for Merchandise Security and filed Apr. 24, 2015, U.S. Patent Publication No. 2013/0081434, entitled Cabinet Lock for Use with Programmable Electronic Key and filed Sep. 28, 2012, U.S. Patent Publication No. 2012/0047972, entitled Electronic Key for Merchandise Security Device and filed Aug. 31, 2011, and U.S. Patent Publication No. 2011/0254661, entitled Programmable Security System and Method for Protecting Merchandise and filed Jun. 27, 2011, each disclosure of which is incorporated by reference herein in its entirety. In other embodiments, the electronic lock 12 and the electronic device 50 are similar to those manufactured by InVue Security Products Inc., including Electronic locks, Plunger Locks, Smart Locks, and IR2 and IR2-S Keys.

Figure 17:
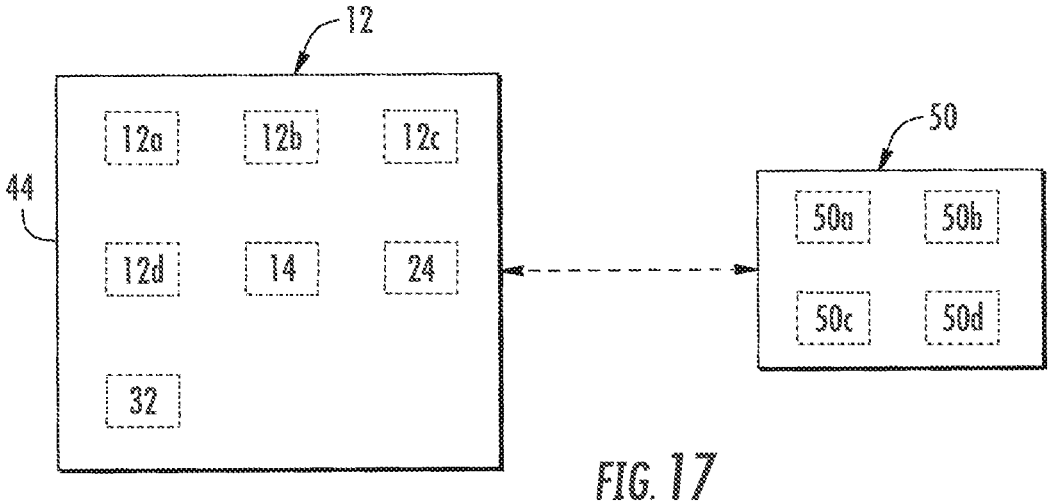
FIG. 17 is a schematic of a lock and an electronic device according to one embodiment of the present invention.

In one embodiment, the electronic device 50 is an electronic key configured to transfer power to the electronic lock 12. In some cases, the electronic device 50 is configured to function as a non-mechanical, contactless key for locking and/or unlocking the electronic lock 12. The electronic device 50 may include various components known to those skilled in the art, such as, for example, a housing, a controller or processor 50*a* disposed within the housing, a display disposed on the housing and coupled to the processor, a power source 50*b*, wireless communication functionality 50*c*, an internal memory 50*d*, a SIM card and/or SM card, a camera, a speaker, and/or a user interface (see, e.g., FIG. 17). The power source 50*b* may be a multiple-use internal power source, such as a conventional capacitor or rechargeable battery.

Figure 3:
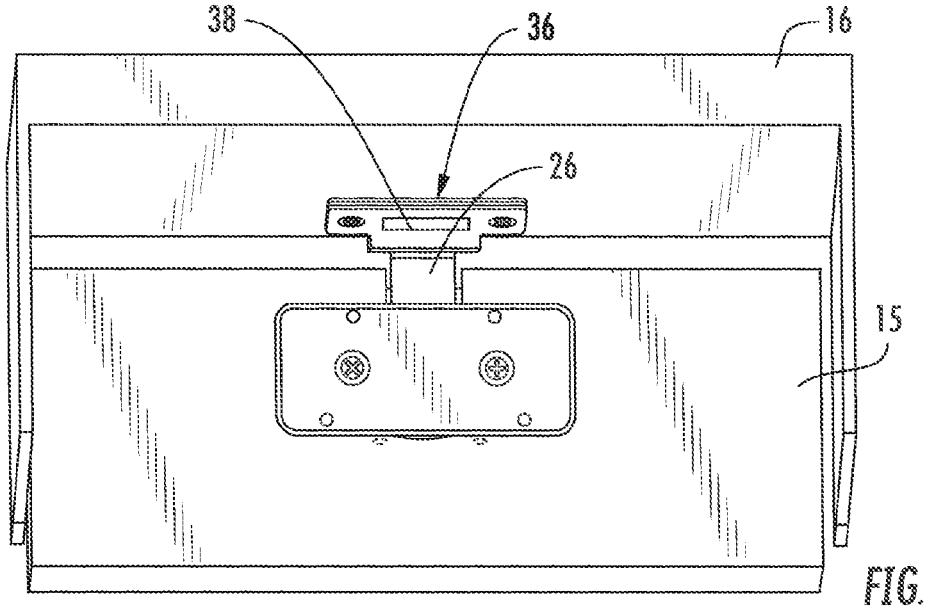
FIG. 3 is a rear view of the merchandise security device shown in FIG. 1.
Figure 11:
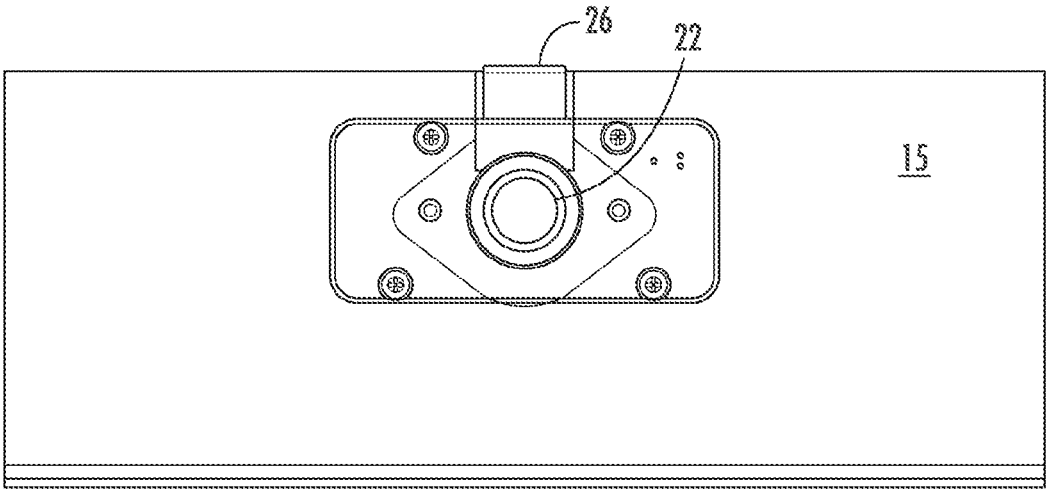
FIG. 11 is a front view of the lock shown in FIG. 9, with the actuator in a retracted position.
Figure 12:
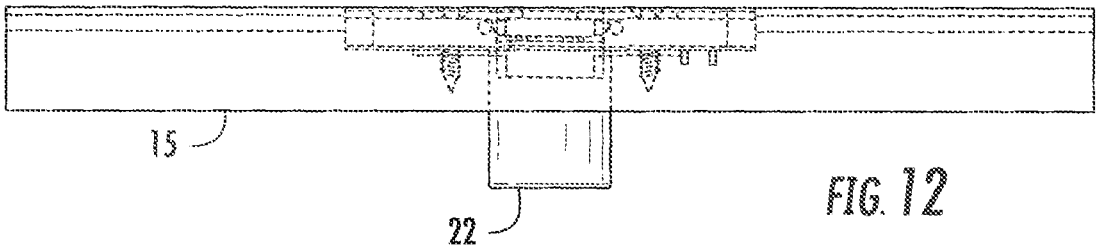
FIG. 12 is a plan view of the lock shown in FIG. 9.

The electronic lock 12 may include a housing 20 that is configured to contain a variety of components. The housing 20 may be secured to the drawer 15 using any desired technique, such as fasteners and/or adhesives. As shown in FIGS. 3, 11, and 12 (a portion of the drawer 15 being transparent for purposes of illustration), for example, the housing 20 is fastened to an inner surface of the drawer 15 so as to be inaccessible when the drawer is in a closed position. A portion of the housing 20 may extend through the drawer 15, such as to provide access to a transfer port 22. The transfer port 22 may facilitate communication between the electronic device 50 and the electronic lock 12. In some cases, the communication between the electronic lock 12 and the electronic device 50 is wireless, although wired communication may be used in other cases. Moreover, the housing 20 may contain a controller or processor 12*a* that is in communication with a lock mechanism 24. The processor 12*a* may be configured to actuate the lock mechanism 24 in response to receiving electrical power from the electronic device 50.

The electronic lock 12 may also contain an internal source of electrical power 12*b*, such as one or more capacitors, batteries, or the like. However, in other embodiments, the electronic lock 12 may not include an internal power source, and as such, may be "electrically passive". In this case, the electronic device 50 may contain an internal source of electrical power 50*b*, such as a conventional extended-life or rechargeable battery, capacitor or the like, that is configured to transfer electrical power to the electronic lock 12 for at least the purpose of unlocking the drawer 15. The electronic device 50 may transfer electrical power to the electronic lock 12 in any suitable manner, such as by electrical contacts, acoustical transmission (e.g. RF signals), or magnetic induction. In this regard, the electronic lock 12 and the electronic device 50 may each contain inductive coils for transferring power from the electronic device to the electronic lock. In one embodiment, electrical power transferred by the electronic device 50 is configured to charge an internal power source 12*b* of the electronic lock 12. For example, the electronic lock 12 may include one or more capacitors that are configured to be charged in response to receiving electrical power from the electronic device 50. The capacitor(s) may be used to perform one or more functions as will be described in further detail below. Thus, the electronic lock 12 may be configured to harvest energy provided by the electronic device 50.

Figure 6:
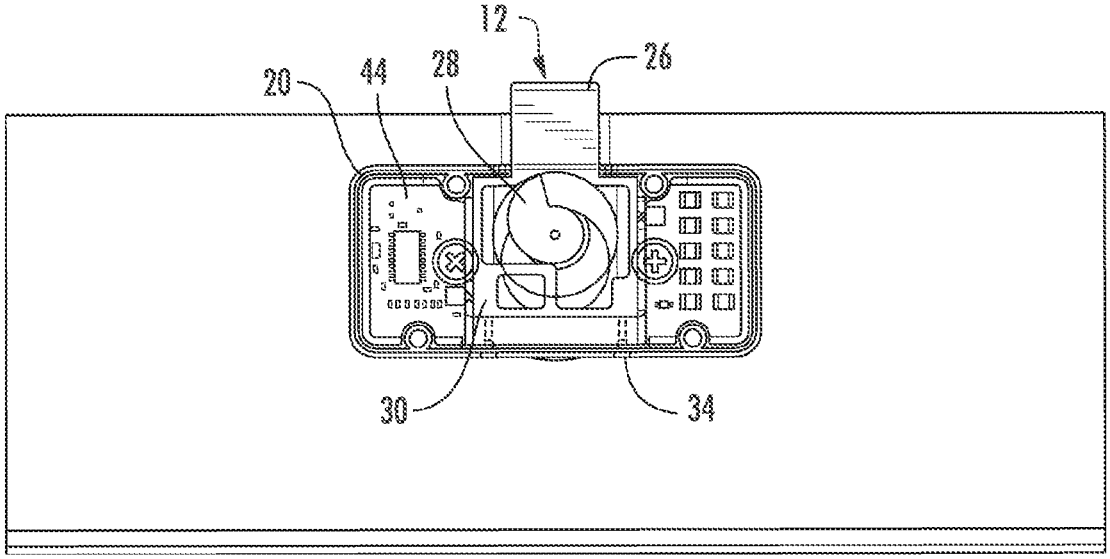
FIG. 6 is a rear view of a lock, with the actuator in an extended position, according to one embodiment of the present invention.
Figure 7:
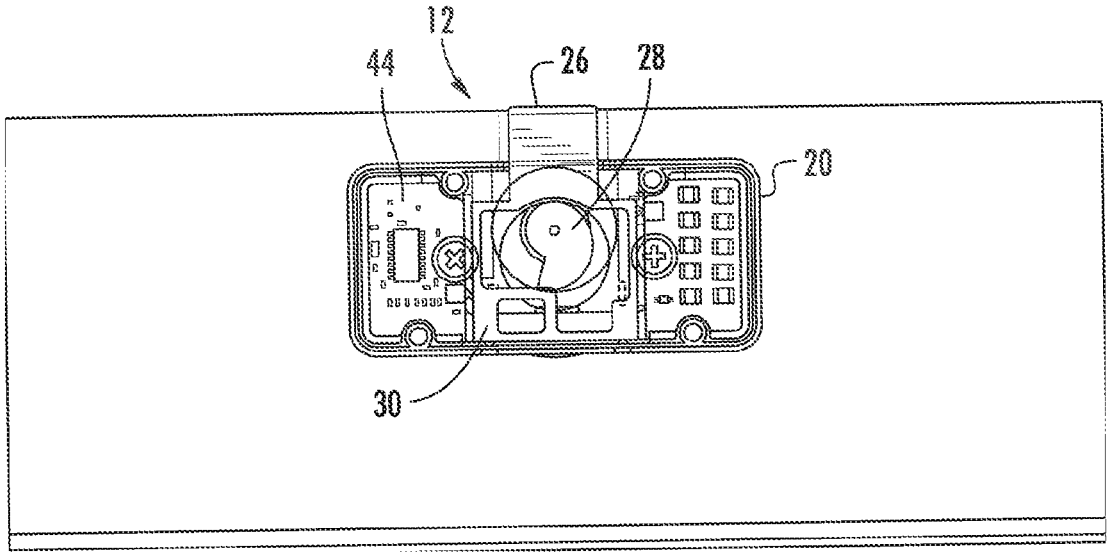
FIG. 7 is another rear view of the lock shown in FIG. 6, with the actuator in a retracted position.
Figure 8:
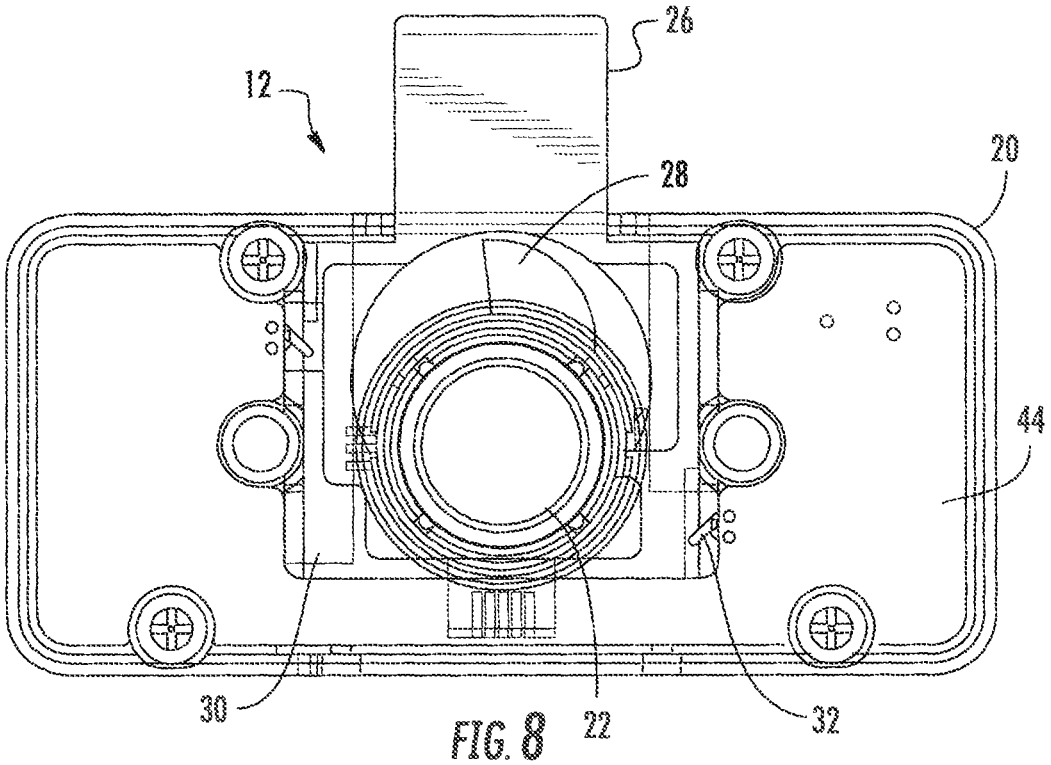
FIG. 8 is a front view of the lock shown in FIG. 6, with the actuator in an extended position.
Figure 9:
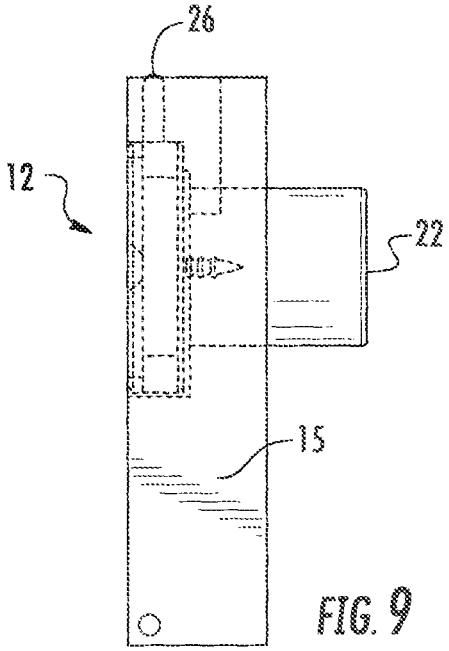
FIG. 9 is a side view of a lock according to one embodiment of the present invention.
Figure 10:
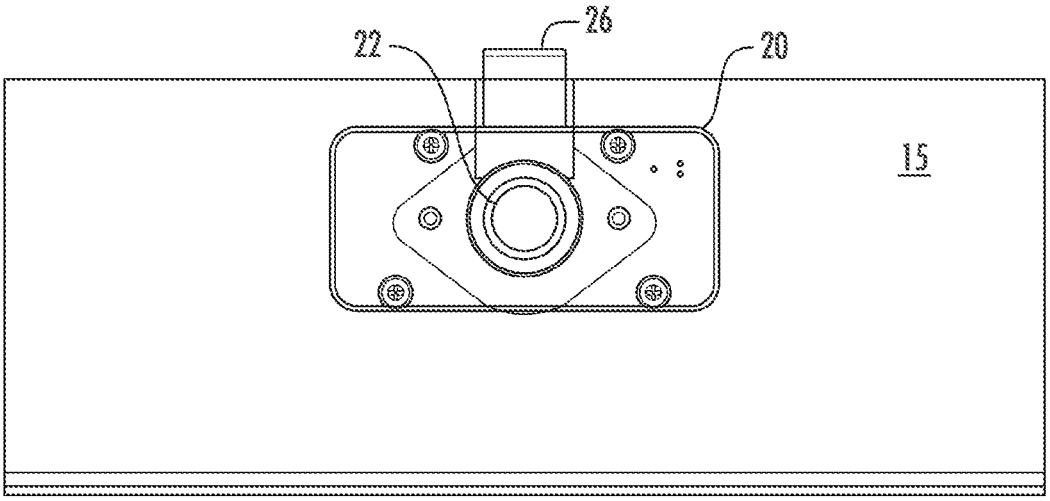
FIG. 10 is a front view of the lock shown in FIG. 9, with the actuator in an extended position.
Figure 13:
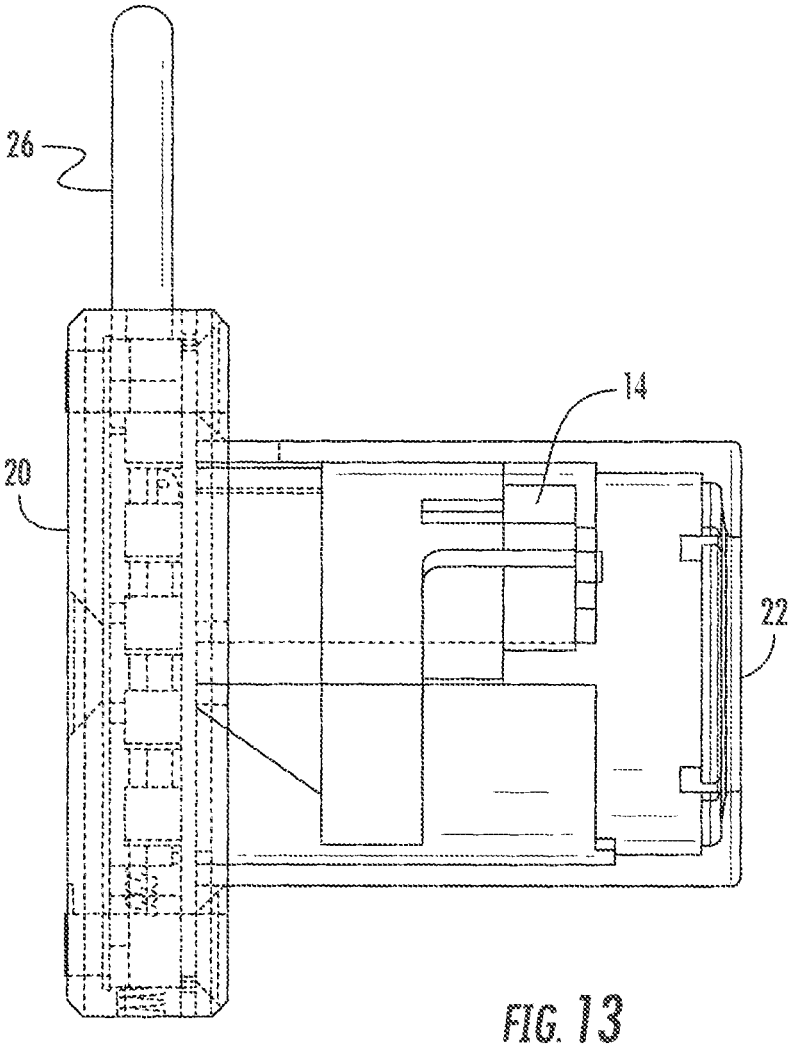
FIG. 13 is a side view of a lock according to one embodiment of the present invention.

As previously mentioned, the electronic lock 12 may include a lock mechanism 24 configured to move between locked and unlocked configurations. In the illustrated embodiment, the lock mechanism 24 is a mechanical lock including an actuator 26 that is configured to move linearly between an extended position (see, e.g., FIGS. 6 and 10) and a retracted position (see, e.g., FIGS. 7 and 11). However, it is understood that the lock mechanism 24 may be any suitable mechanism that is configured to move between locked and unlocked states or positions, such as a plunger, cam, or the like for facilitating mechanical actuation. The electronic lock 12 may be equipped with an electric motor, DC stepper motor, solenoid, or the like, that is in communication with a processor and powered by an internal power source for actuating the lock mechanism 24. In one example, power provided by the electronic device 50 may be used to power a motor 14 for actuating the lock mechanism 12 (see, e.g., FIG. 13, a portion of the housing 20 being transparent for purposes of illustration). FIGS. 6-8 (a portion of the housing 20 being transparent for purposes of illustration) show that the electronic lock 12 may include a circuit board 44 for electrical connection to various electrical components, such as the motor 14, power source 12*b*, processor 12*a*, etc.

The actuator 26 is configured to operably engage a strike plate 36 in a locked state. The strike plate 36 may include an opening 38 defined therein for receiving a portion of the actuator 26. The strike plate 36 may also include a curved portion 40 that extends outwardly from the merchandise fixture 13. The curved portion 40 may be positioned relative to the merchandise fixture 13 to facilitate engagement between the actuator 26 and the strike plate 36. For instance, as the drawer 15 is moved to a closed position, the actuator 26 may be configured to engage the curved portion 40 to thereby urge the actuator to retract and allow the drawer to fully close relative to the support structure 16. However, in other embodiments, the strike plate 36 may not include a curved portion 40. The strike plate 36 may be configured to be secured to the merchandise fixture 13 using a variety of techniques, such as via one or more fasteners.

FIGS. 6-8 show an embodiment of a lock mechanism 24 whereby a motor 14 is configured to rotate a camming mechanism 28. In this regard, the camming mechanism 28 is connected to the actuator 26 such that rotation of the camming mechanism 28 results in actuation of the actuator 26. The lock mechanism 24 may include a follower mechanism 30 that is configured to engage the camming mechanism 28. In the illustrated embodiment, the follower mechanism 30 defines an opening configured to receive and facilitate engagement with the camming mechanism 28. In some cases, the actuator 26 is attached to the follower mechanism 30, while in other cases, the actuator and follower mechanism may be integrally formed. FIG. 6 shows the lock mechanism 24 in a locked state whereby the actuator 26 extends outwardly therefrom. In the locked state, the camming mechanism 28 is not engaged with the follower mechanism 30. FIG. 7 shows the lock mechanism 24 in an unlocked state whereby the actuator 26 is retracted relative to the lock mechanism. In the unlocked state, the camming mechanism 28 is in engagement with the follower mechanism 30. Thus, engagement of the camming mechanism 28 with the follower mechanism 30 forces the actuator to a retracted position. FIG. 8 shows that the lock mechanism 24 may also include one or more switches 32 in communication with a processor 12*a*. The switch 32 may be actuated in response to engagement with the follower mechanism 30 which results in the processor 12*a* deactivating the motor 14. As such, once the actuator 26 is moved to an unlocked state, the motor 14 is temporarily deactivated.

Advantageously, the lock mechanism 24 may be configured to automatically move from an unlocked state to a locked state. As noted above, the electronic device 50 may be configured to transfer power to the electronic lock 12 for operating the lock mechanism 24, which may be used to charge one or more capacitors. Power stored by the capacitor (s) may be used to activate the motor 14 to move the actuator 26 from the unlocked state to a locked state. The processor 12*a* may be configured to activate the motor 14 after a predetermined period time after the lock mechanism 24 has been unlocked (e.g., about 1 second, about 2 seconds, about 3 seconds, about 4 seconds, about 5 seconds, etc.). Therefore, the lock mechanism 24 is configured to self lock after remaining in an unlocked state for a predetermined period of time. In use, when the lock mechanism 24 is unlocked with the electronic device 50 and the drawer 15 is opened, the lock mechanism will move to the locked state after a predetermined period of time. The lock mechanism 24 may include a biasing element 34 (e.g., a spring) and be configured to automatically lock when the drawer 15 is moved to a closed position. For instance, the actuator 26 may be biased towards the locked state such that the relaxed state of the actuator is in an extended position.

In some embodiments, the electronic lock 12 may include a plurality of internal power sources 12*b*. As discussed above, the electronic lock 12 may include a capacitor for automatically actuating the lock mechanism 24 from an unlocked state to a locked state. For instance, a power source 12*b* may be used to activate a motor 14, while the same or an additional power source may be employed for the processor 12*a*. The lock mechanism 24 may include an internal power source 12*b* for performing other functions, such as for auditing of the electronic lock 12 and/or the electronic device 50. For example, the electronic lock 12 may be configured to store in memory 12*c* information relating to the electronic device 50, the date and/or time of the unlocking and/or locking event, the number of unlocking and/or locking events, etc. In one example, the lock mechanism 24 may be configured to provide data to the electronic device 50 upon communication with the electronic device for unlocking the lock mechanism. Because the lock mechanism 24 is configured to self lock automatically, there may be no data as to when relocking occurred. Thus, the internal power source 12*b* (either the same as the power source to unlock the lock mechanism or a different power source) of the lock mechanism 24 may be configured to capture data of the re-lock event which may occur several minutes or hours later.

In one embodiment, the electronic lock 12 may be configured to detect when the drawer 15 is moved to a closed position within the support structure 16. For instance, the electronic lock 12 may include a sensor 12*d* to detect that it has engaged a strike plate 36 or other device disposed within the support structure 16. The sensor 12*d* could be any suitable device configured to detect the strike plate 36 or other device within the support structure, such as a proximity switch, a pressure or plunger switch, an optical switch, an NFC tag, a Hall-effect sensor, or the like. For example, the electronic lock 12 may include a proximity mechanism, such as a reed switch or a Hall effect sensor, and the support structure 16 may include a magnet. The magnet is positioned such that the proximity mechanism is proximate to the magnet when the drawer 15 is in a closed position. The proximity mechanism detects the magnet which provides a signal to the electronic lock 12 to store data regarding the drawer 15 being moved to a closed position. Upon detection of the strike plate 36, the electronic lock 12 may be configured to store data relating to the drawer 15 closing, such as the date and/or time of closing.

The electronic device 50 is configured to at least unlock the electronic lock 12 from the locked configuration. The electronic device 50 is not required to place the electronic lock 12 into the locked configuration after the drawer 15 is moved to the closed position. Thus, a sales associate is unable to leave an electronic lock 12 in an unlocked state. In some embodiments of the invention, a successful activation of the electronic device 50 occurs, for example, when a security code of the electronic device, for example a programmable electronic key, matches a security code assigned to the electronic lock 12. Therefore, only when the codes match will the electronic device 50 transfer power to the electronic lock 12.

Regardless, the electronic device 50 may be positioned proximate to, near, or adjacent to, the drawer 15 for activating the electronic lock 12. The electronic device 50 may be activated simply by being placed in proximity to the electronic lock 12 to thereby initiate communication between the electronic device and the electronic lock. For example, the electronic device 50 may be configured to communicate with the electronic lock 12 within a particular distance, such as, for example, within about 5 inches, within about 4 inches, within about 3 inches, within about 2 inches, or within about 1 inch.

Figure 4:
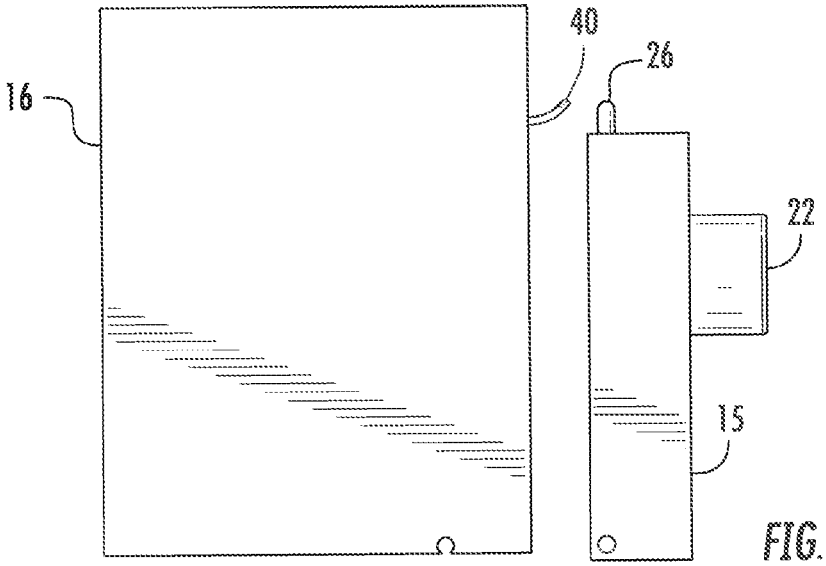
FIG. 4 is a side view of the merchandise security device shown in FIG. 1.
Figure 5:
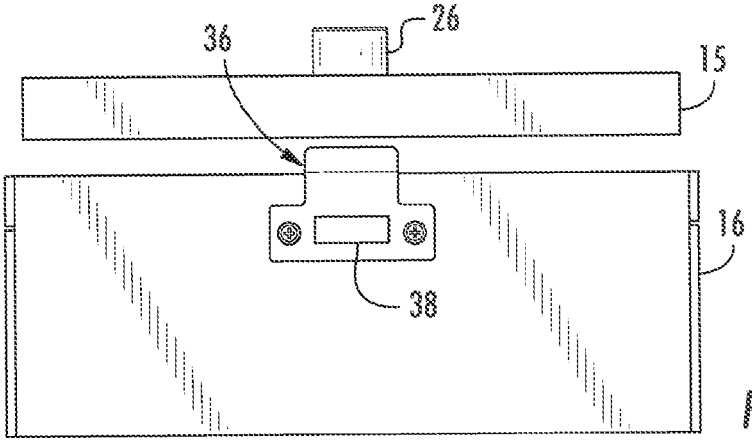
FIG. 5 is a partial plan view of the merchandise security device shown in FIG. 1.
Figure 14:
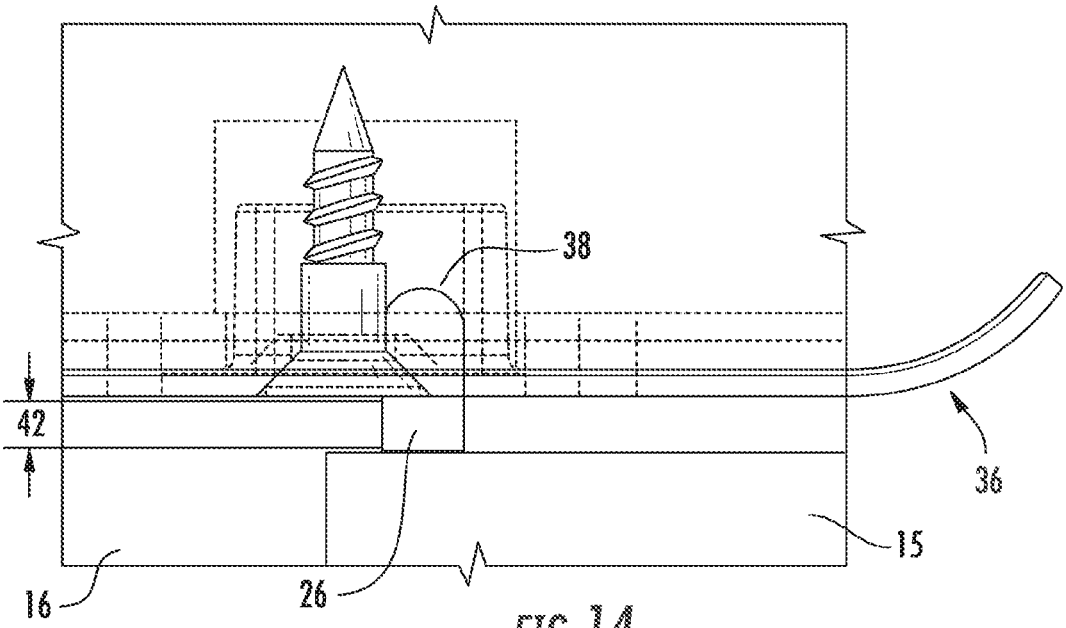
FIG. 14 is a side view of an actuator engaged with a strike plate according to one embodiment of the present invention.
Figure 15:
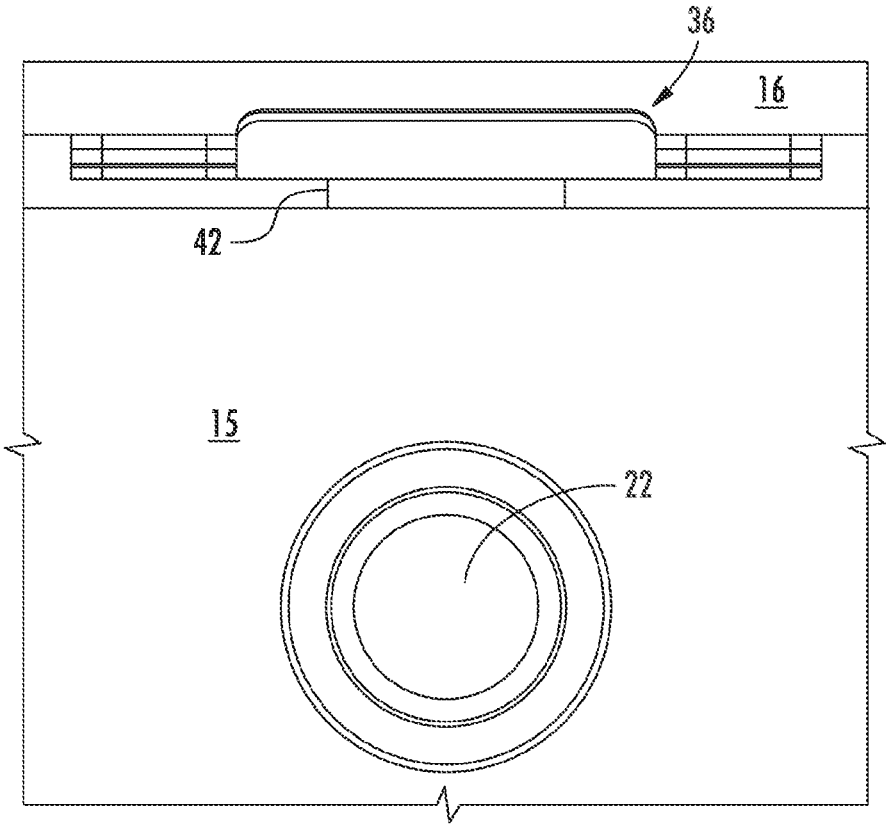
FIG. 15 is a front view of an actuator engaged with a strike plate according to one embodiment of the present invention.

In some embodiments, the actuator 26 is configured to limit "picking" of the electronic lock 12. In this regard, a thief may attempt to insert a tool or other object between the strike plate 36 and the merchandise fixture 13 for biasing the actuator 26 out of engagement with the strike plate. Conventional actuators include an angled or curved portion that extends from the merchandise fixture and engages the strike plate, and when a horizontal force is applied to the angled or curved portion, a resultant down force causes the actuator to retract thereby allowing the lock to be defeated. In contrast, embodiments of the present invention provide an actuator 26 that includes a uniform cross section along at least a portion of its length. For example, FIGS. 4-5 show that the actuator 26 may include a rectangular cross section along at least a portion of the actuator (defined by a straight portion on the front and rear surfaces of the actuator and a pair of side surfaces extending therebetween) that extends outwardly from the drawer 15 in the locked state. Depending on the orientation of the electronic lock 12, a portion of the lock 12 extending outwardly from the drawer 15 may include all vertical surfaces or surfaces that are parallel to one another. Thus, at least a portion of the actuator 25 may be straight or not curved or rounded. A free end of the actuator 26 may include a curved or rounded portion that facilitates engagement with the strike plate 36 when moving the merchandise fixture 13 towards a locked state. However, in a locked state, the portion of the actuator 26 that extends between the bottom surface of the strike plate 36 and the top surface of the drawer 15 is not curved (see, e.g., FIGS. 14-15, portion labeled 42, a portion of the drawer 15 and support structure 16 being transparent for purposes of illustration), while the curved or rounded portion is received entirely by the strike plate. Thus, any force applied to the exposed portion of the actuator 26 will not result in a downward retracting force. Although described in conjunction with an electronic lock 12, it is understood that the actuator 26 may be used with purely mechanical locks in other embodiments.

Figure 18:
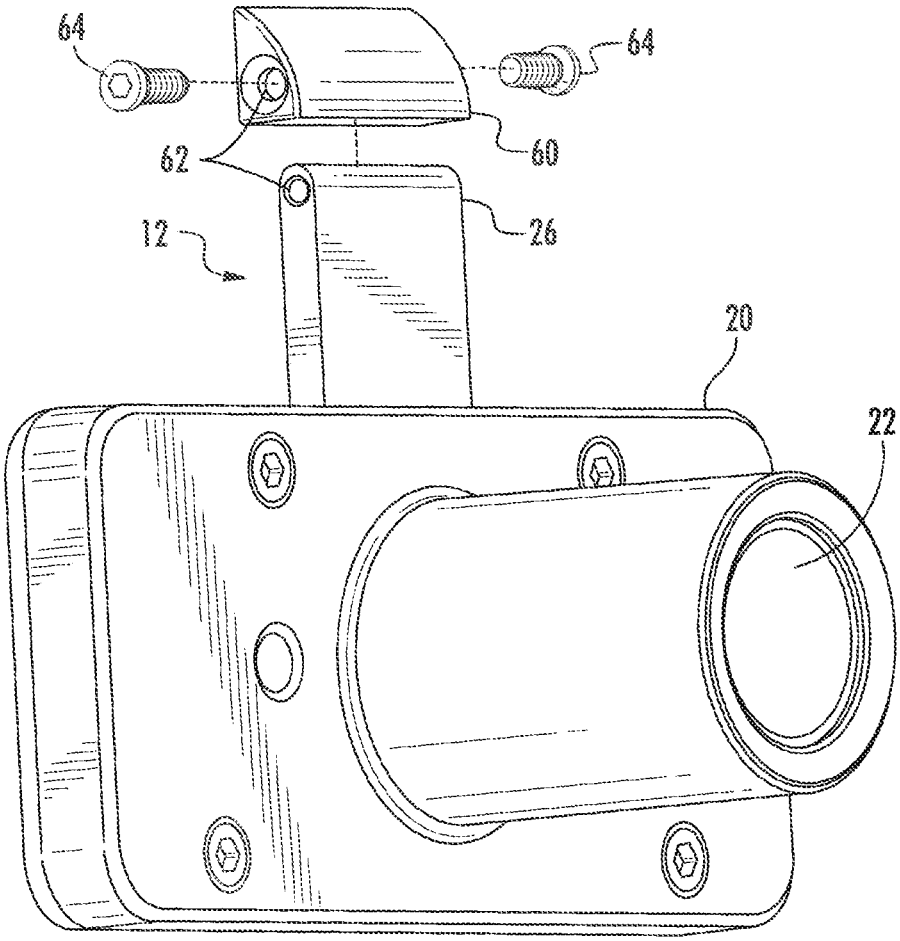
FIG. 18 is a perspective view of an adapter and a lock according to one embodiment of the present invention.

In one embodiment shown in FIG. 18, the lock 12 may include an adapter 60 configured to engage the actuator 26. The adapter 60 may be used to facilitate installation and use of the lock 12 with the strike plate 36. In this regard, the adapter 60 may be configured to releasably engage the free end of the adapter 26. For example, FIG. 18 shows that the actuator 26 and the adapter 60 may each include openings 62 configured to receive fasteners 64 for securing the adapter to the free end of the actuator. When secured to the actuator 26, the adapter 60 facilitates engagement with the strike plate 36 due to its curved surface. Thus, the adapter 60 may be secured to the actuator 26 such that the curved surface of the adapter engages the curved portion 40 of the strike plate 36. In some cases, the curved portion 40 of the strike plate 36 may be omitted, and the curved surface of the adapter 60 facilitates engagement of the actuator 26 with the strike plate. The larger surface area of the curved surface of the adapter 60 may also allow for greater tolerance between the actuator 26 and the strike plate 36. However, when the adapter 60 engages the strike plate 36 in a locked state, the portion 42 of the actuator 26 extending between the bottom surface of the strike plate 36 and the top surface of the fixture 13 is not curved (see, e.g., FIGS. 14 and 15 discussed above). Thus, the adapter 60 may be configured to be entirely received within the opening 38 of the strike plate 36. Moreover, the adapter 60 may be secured to the actuator 26 in one of two different and opposite orientations depending on the desired orientation of the lock 12 relative to the display fixture 13. Thus, the adapter 60 may be readily secured and removed without having to disassemble the lock 12.

In addition, the configuration of the actuator 26 may facilitate adaptability to different types of merchandise display fixtures 13. For example, FIG. 1 shows an embodiment of a merchandise fixture 13 including a movable drawer 15 and a fixed support structure 16. Thus, the electronic lock 12 may be configured to be mounted to the drawer 15, while the strike plate 36 is configured to be mounted to the support structure 16. In some cases, the electronic lock 12 may be fixed, while the strike plate 36 is configured to be mounted to a movable structure. For instance, FIG. 16 shows an instance where the electronic lock 12 is mounted to a stationary structure 16', while the strike plate 36 is mounted to a pivoting drawer 15' or the like. With respect to conventional locks that include an angled or curved portion on the end of the actuator, the orientation of the actuator needs to be facing in a direction that facilitates engagement with the angled or curved portion when closing the movable structure. Thus, the orientation of the lock needs to be reversed so that the angled or curved portion is properly positioned. In contrast, embodiments of the present invention allow for reversibility of use without having to change the orientation of the electronic lock 12. Namely, a comparison between FIGS. 1 and 16 shows that the orientation of the electronic lock 12 remains the same whether mounted to a movable drawer 15' (e.g., FIG. 1) or mounted to a stationary structure 16' (e.g., FIG. 16). Thus, the lock 12 is capable of being secured to the merchandise fixture 13 in one of two different and opposite orientations without affecting the functionality of the lock.

Therefore, embodiments of the present invention may provide several advantages. For instance, a sales associate is not required to lock the electronic lock after being unlocked since the lock mechanism is configured to self lock automatically. Moreover, the drawer is able to be closed while the lock mechanism is in an locked state such that the electronic lock does not need to communicate with the electronic device in order to close the drawer. In addition, the electronic lock cannot be left in an unlocked state, even after communicating with an electronic device and while the drawer remains closed, since the lock mechanism self locks after a predetermined period of time. Unlike conventional mechanical keys that can function as a "handle" when in an unlocked state, the electronic key allows for automatic relocking even when the electronic device is no longer in communication therewith. Furthermore, the electronic lock includes "anti-picking" features that resist defeating the lock while in a locked state. The electronic lock also allows for use with different types of merchandise fixtures, and may be mounted to stationary or movable merchandise fixtures or components thereof.

The foregoing has described one or more embodiments of a merchandise security device, system and method for protecting an item of merchandise from theft. Embodiments of a merchandise security device and system have been shown and described herein for purposes of illustrating and enabling the best mode of the invention. Those of ordinary skill in the art, however, will readily understand and appreciate that numerous variations and modifications of the invention may be made without departing from the spirit and scope thereof. Accordingly, all such variations and modifications are intended to be encompassed by the appended claims.

That which is claimed is:

1. A merchandise security device for protecting an item of merchandise from theft, the merchandise security device comprising:

a lock configured to be secured to a merchandise fixture, wherein the lock is an electronic lock; and a strike plate configured to be secured to the merchandise fixture, wherein the lock comprises an actuator configured to extend into operable engagement with the strike plate in a locked state and to retract out of operable engagement with the strike plate in an unlocked state, wherein the lock comprises a camming mechanism operably engaged with a follower mechanism, the camming mechanism configured to engage the follower mechanism for moving the actuator between the locked state and the unlocked state, wherein the lock comprises a motor configured to move the actuator from the locked state to the unlocked state, an axis of rotation of the motor corresponding to an axis of rotation of the camming mechanism, wherein the actuator comprises a front surface and a rear surface that are symmetrical to one another, each of the front and rear surfaces having a curved portion at a free end of the actuator and a straight portion extending from the curved portion, and wherein the strike plate is configured to receive the entire curved portions in the locked state.

2. The merchandise security device of claim 1, wherein the actuator comprises a pair of side surfaces extending between the straight portions, and wherein the side surfaces and the straight portions define a rectangular cross section.

3. The merchandise security device of claim 2, wherein the straight portions of the actuator are configured to extend outwardly from the merchandise fixture in the locked state.

4. The merchandise security device of claim 1, wherein the straight portions of the actuator are configured to extend at least between a bottom surface of the strike plate and a top surface of the merchandise fixture in the locked state.

5. The merchandise security device of claim 1, wherein the actuator is configured to move linearly between the locked state and the unlocked state.

6. The merchandise security device of claim 1, wherein the lock is configured to be selectively mounted to either of a fixed merchandise fixture or a movable merchandise fixture.

7. The merchandise security device of claim 1, wherein the actuator is biased towards the locked state.

8. The merchandise security device of claim 1, wherein the lock is configured to be secured to a movable merchandise fixture, and wherein the strike plate is configured to be secured to a fixed merchandise fixture.

9. The merchandise security device of claim 1, wherein the actuator is configured to move automatically from the unlocked state to the locked state after a predetermined period of time.

10. The merchandise security device of claim 1, wherein the lock comprises a lock mechanism configured to be actuated between a locked state and an unlocked state in response to communication between the lock and an electronic device.

11. The merchandise security device of claim 1, wherein the lock comprises a memory for storing data relating to locking and unlocking the lock, wherein the data comprises information relating to an electronic key used to unlock the lock, the date and/or time of unlocking the lock, and the date and/or time of relocking of the lock.

12. The merchandise security device of claim 1, wherein the lock further comprises an internal source of electrical power configured to facilitate actuation of the lock from the unlocked state to the locked state.

13. The merchandise security device of claim 12, wherein the source of electrical power comprises a capacitor configured to be charged by an electronic device in communication with the lock.

14. The merchandise security device of claim 10, wherein the electronic device comprises an electronic key configured to transfer power to the lock.

15. The merchandise security device of claim 1, further comprising a sensor configured to detect the position of the follower mechanism relative to the merchandise fixture.

16. The merchandise security device of claim 1, wherein the curved portions collectively define a semi-circular shape.

17. The merchandise security device of claim 1, wherein the follower mechanism defines (i) an opening configured to receive and encircle the camming mechanism, (ii) an upper surface in engagement with the actuator, and (iii) a lower surface, and wherein the camming mechanism is configured to rotate into engagement with the lower surface of the follower mechanism in the unlocked state.

18. The merchandise security device of claim 1, wherein the lock comprises a housing having a first portion and a second portion, the first portion configured to be mounted within the merchandise fixture and the second portion containing the motor and configured to extend outwardly from the merchandise fixture.

19. The merchandise security device of claim 18, further comprising a port located at a free end of the second portion and configured to communicate with an electric device for providing power to the motor.

20. A method for protecting merchandise from theft, the method comprising:

selectively securing a strike plate to a fixed merchandise fixture or a movable merchandise fixture;

selectively attaching a lock in a first orientation or a second orientation opposite the first orientation to one of the fixed merchandise fixture or the movable merchandise fixture, wherein the lock is an electronic lock, the lock comprising an actuator configured to extend into operable engagement with the strike plate in a locked state and to retract out of operable engagement with the strike plate in an unlocked state, wherein the actuator comprises a curved portion at its free end and a straight portion extending from the curved portion, and wherein the strike plate is configured to receive the entire curved portion in the locked state, wherein the lock comprises a camming mechanism operably engaged with a follower mechanism, the camming mechanism configured to engage the follower mechanism for moving the actuator between the locked state and the unlocked state, wherein the lock comprises a motor configured to move the actuator from the locked state to the unlocked state, an axis of rotation of the motor corresponding to an axis of rotation of the camming mechanism; and actuating the lock to move the actuator from the locked state to the unlocked state.

* * * * *